US005769376A

United States Patent [19]

Bostic et al.

[11] Patent Number: 5,769,376

[45] Date of Patent: Jun. 23, 1998

[54] SUPPORT FOR COLLECTING LIQUID FROM METAL COILS

[75] Inventors: Jim Bostic, Avon Lake; Ronald E. Stokey, Brook Park, both of Ohio

[73] Assignee: Roll Form Tech Ltd., North Ridgeville, Ohio

[21] Appl. No.: 624,975

[22] Filed: Mar. 28, 1996

[51] Int. Cl.[6] ..... B65D 19/00; B65D 19/06

[52] U.S. Cl. ..... 248/346.01; 248/346.02; 248/346.5; 108/55.1; 108/55.3

[58] Field of Search ..... 248/346.01, 346.02, 248/346.4, 346.5, 346.11, 154; 108/55.1, 55.3, 54.1; 403/364

[56] References Cited

U.S. PATENT DOCUMENTS

| | | | |
|---|---|---|---|
| 921,192 | 5/1909 | Wheeler . | |
| 2,338,645 | 1/1944 | James | 108/55.1 X |
| 3,269,336 | 8/1966 | Naylor et al. | 108/55.1 |
| 3,430,586 | 3/1969 | Oswald | 108/55.3 |
| 3,433,184 | 3/1969 | Addy | 108/55.3 X |
| 3,650,224 | 3/1972 | Petix et al. | 108/51.1 |
| 3,664,570 | 5/1972 | Kupersmit | 108/55.1 X |
| 3,699,901 | 10/1972 | Cook, III | 108/51.1 |
| 3,753,407 | 8/1973 | Tilseth | 108/55.3 X |
| 3,776,435 | 12/1973 | Smith | 108/55.1 X |
| 4,249,657 | 2/1981 | Bates | 248/346.01 X |
| 5,092,251 | 3/1992 | Hamaker et al. | 108/51.1 |
| 5,105,746 | 4/1992 | Reynolds | 108/51.1 X |
| 5,520,121 | 5/1996 | Scubart et al. | 108/55.3 X |

FOREIGN PATENT DOCUMENTS

| | | | |
|---|---|---|---|
| 2231575 | 12/1974 | France | 108/55.1 |
| 2918573 | 11/1980 | Germany | 108/51.1 |
| 1624218 | 1/1991 | Russian Federation | 403/364 |

*Primary Examiner*—Robert W. Gibson, Jr.
*Assistant Examiner*—Stephen S. Wentsler
*Attorney, Agent, or Firm*—Watts, Hoffman, Fisher & Heinke

[57] ABSTRACT

A coil support holds a coil of metal or other material and contains liquid dripping from the coil. The coil support includes a base defining a floor. An upstanding peripheral wall extends from the base. The base and the wall define at least one liquid collection area. The floor has a tapered area whereby liquid dripping onto the tapered area will flow into the collection area. Coil support members on the base support the coil above the floor. The coil support members may be comprised of elastomeric material to minimize damage to the coil.

21 Claims, 3 Drawing Sheets

SUPPORT FOR COLLECTING LIQUID FROM METAL COILS

FIELD OF THE INVENTION

The present invention relates to a device for supporting a coil of metal or other material and for containing fluid that drips from the coil.

BACKGROUND OF THE INVENTION

In the process of making steel strip the steel comes into contact with oil, acid and other fluids and particles which adhere to the strip. The steel strip is often coiled for transport and storage. A steel coil includes two end portions spaced apart from each other and a side that extends between the end portions. An opening extends between end faces of the coil.

The side of the coil may be supported for storage and transport on a flat rectangular block of material. When supporting the coil in this manner the oily fluid runs down the coil, onto the flat base and then onto the floor where it creates an undesirable spill. The coil may be stored in locations such as in a steel plant, an automotive plant or a steel warehouse. Therefore, of greater concern than the mess created by the spill is the danger that workers may slip on the oily floor and injure themselves.

SUMMARY OF THE INVENTION

The present invention relates to a coil support for supporting a coil of metal and containing fluids that drip from the coil. The coil support overcomes the problems of the prior art by preventing spills in the area where the coil support stores the coil. The coil support generally includes a base defining a floor and an upstanding peripheral wall that extends from the base.

The base and the wall define at least one liquid collection area. The floor has a tapered area whereby liquid dripping onto the tapered area will flow into the collection area. Coil support members on the base support the coil above the floor.

In its preferred form each coil support member has a generally ramp-like shape. The coil support members are preferably formed of elastomeric material. This minimizes damage to the coil when it is rested on and removed from the coil support members. The base is generally rectangular and the collection area is preferably disposed at an end portion of the base. The base includes a dovetail joint at its periphery for connection to an adjacent coil support.

The fluid that drips from the coil is contained in the collection area. Therefore, the coil support prevents injury to workers because it does not create a hazardous spill on the floor in the vicinity of the coil support. The fluid may be conveniently removed from the collection area.

A method of the present invention includes the step of supporting the coil above the floor of the base. Fluid dripping from the coil is received onto the tapered area of the floor. The fluid is directed from the tapered area to at least one liquid collection area where the fluid is contained. In its preferred form the method includes the step of directing the fluid toward a collection area at an end portion of the base. The fluid may be removed from any of the collection areas.

Other embodiments of the invention are contemplated to provide particular features and structural variants of the basic elements. The specific embodiments referred to as well as possible variations and the various features and advantages of the invention will become better understood from the detailed description that follows, together in connection with the accompanying drawings.

DETAILED DESCRIPTION OF THE PREFERRED EMBODIMENTS

Figure 1:
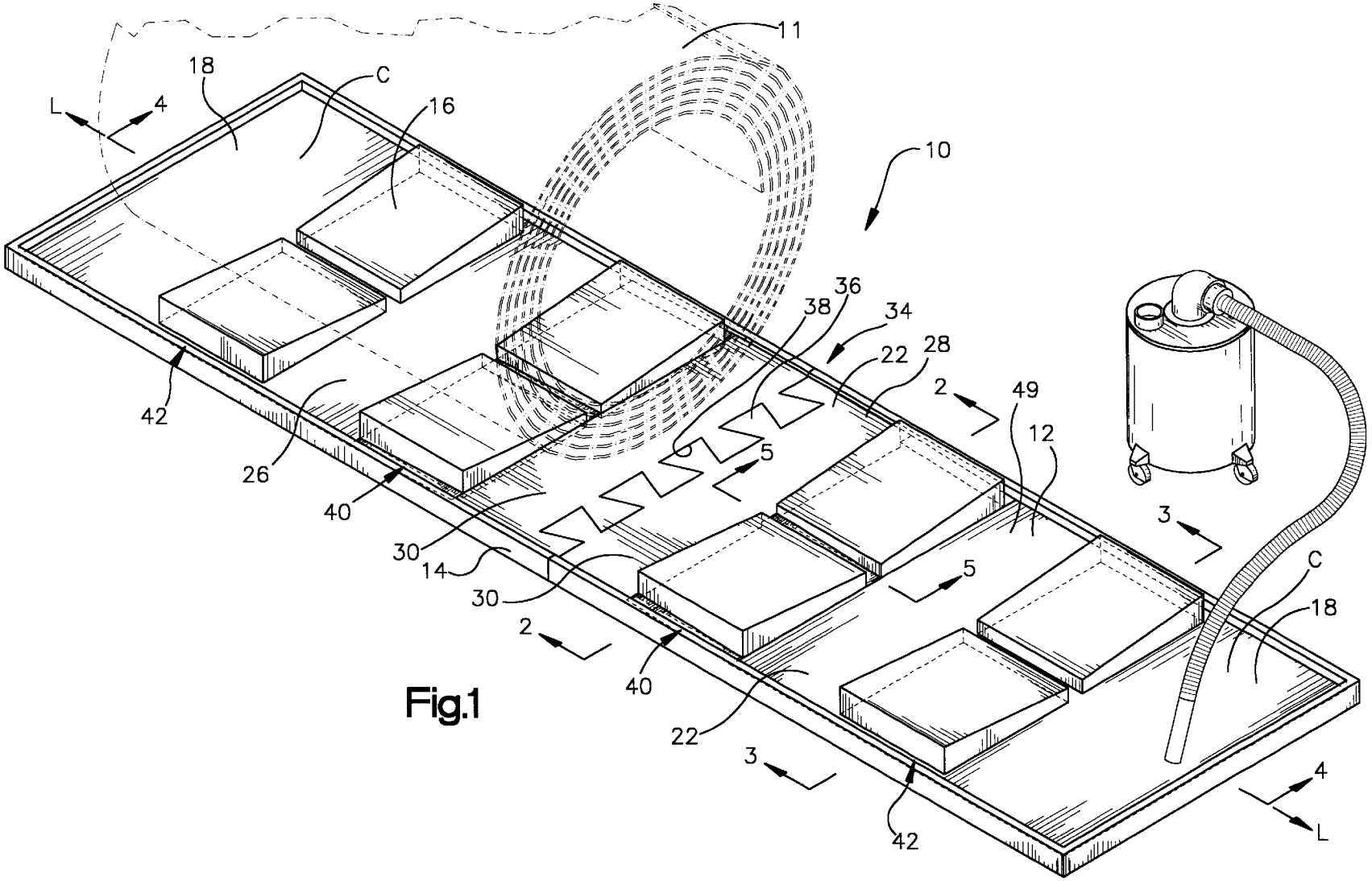
FIG. 1 is a perspective view showing a coil support device constructed in accordance with the present invention.

Turning now to the drawings, a coil support shown generally at 10 is used for supporting a coil 11. The device 10 includes a base 12, an upstanding peripheral wall 14 disposed around the perimeter of the base 12, and coil support members 16 on the base 12. The coil support members 16 are spaced apart from each other along a longitudinal axis L-L of the coil support 10.

The base 12 is preferably rectangular and includes end portions 18 spaced apart from each other in the longitudinal direction and side portions 22 spaced apart from each other in a direction transverse to the longitudinal axis L—L. The peripheral wall 14 extends around the side portions 22 and the end portions 18. The base 12 has a length and width sufficient to receive one or more of the coils 11.

The coil support 10 may be formed as one piece or in separate sections 26, 28 as shown in FIG. 1. Each of the sections 26, 28 has an inner end portion 30. The separate sections 26, 28 may be connected together by any fastening device, but are preferably connected together with a dovetail joint 34 as shown in FIG. 1. Interlocking male portions 36 and female portions 38 of the dovetail joint 34 may be disposed on the inner end portions 30 of each of the sections 26, 28. It will be appreciated by those skilled in the art that the sections 26, 28 may be connected together along their side portions 22. If the coil support 10 is formed as one piece, the lines depicting the dovetail joint 34 in FIG. 1 would not be present.

The coil support members 16 extend upwardly from the base 12 and are located inside the wall 14. Each section 26, 28 preferably includes a first pair 40 and a second pair 42 of the coil support members 16. The coil support members 16 of each pair 40, 42 oppose each other and are spaced apart from each other in the transverse direction. Each coil support member 16 preferably has a ramp-shaped surface 43 that is downwardly tapered toward the longitudinal axis L—L. Thus, the coil support members 16 of each pair define a generally V-shaped space that accommodates the arcuate surface of the coil 11.

Referring now to FIGS. 2–6, the structure of the base 12 will be described by reference to section 28 only, since both of the sections 26, 28 preferably have the same structure. A central portion 44 of the base 12 is flat and has a uniform thickness. The central portion 44 extends in the longitudinal direction from an innermost edge 46 of the section 28 to the first pair of coil support members 40.

Figure 4:
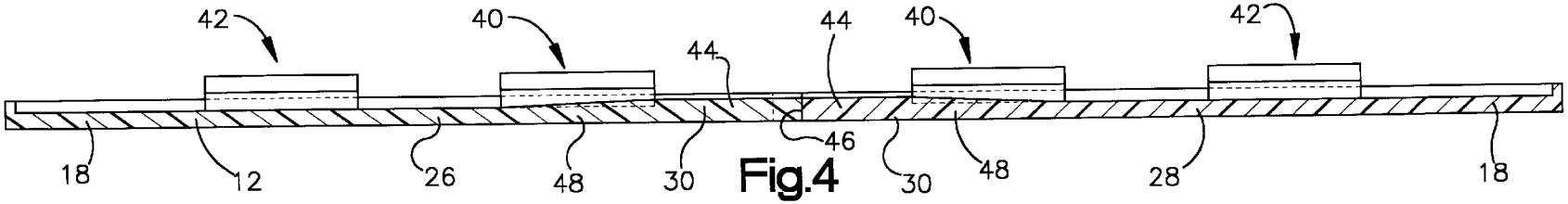
FIG. 4 is a cross-sectional view taken along the plane designated by lines 4—4 in FIG. 1.

As shown in FIG. 4, a tapered portion 48 is preferably nearly coextensive with the first pair of coil support members 40. That is, the tapered portion 48 extends in the longitudinal direction downwardly from the central portion 44 to the end portion 18. The tapered portion 48 preferably extends at an angle of about 5 degrees from horizontal.

Figure 3:
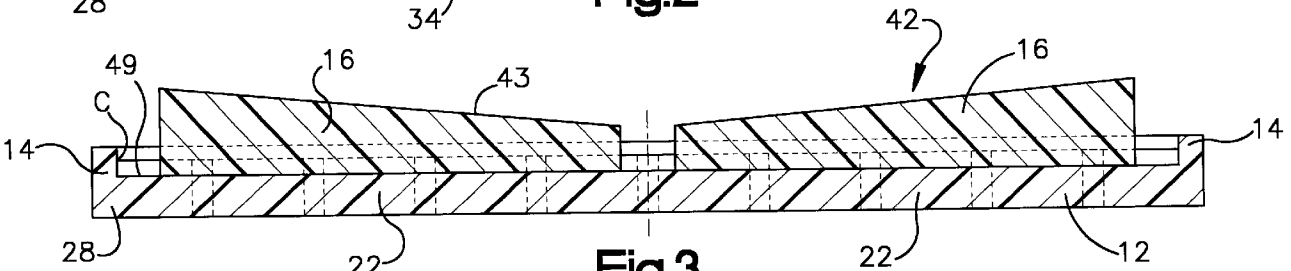
FIG. 3 is a cross-sectional view taken along the plane designated by lines 3—3 in FIG. 1.

The base 12 has a uniform, smallest thickness at the outer end portion 18. The outer end portion 18 preferably begins adjacent the outer end of the tapered portion 48. As best shown in FIG. 3, the walls 14 and a floor 49 of the base 12 at the end portion 18 define a collection area or reservoir C for containing the fluid. One or more of the collection areas C may be formed at different locations of the base 12.

It will be appreciated by those skilled in the art that the tapered portion 48 may extend at different angles, and have different configurations and different lengths. For example, the tapered portion 48 may extend from the inner edge 46 all the way to the wall 14 at the end portion 18. The coil support 10 may optionally include tapholes (not shown) for removing the oily fluid from the base 12.

Figure 2:
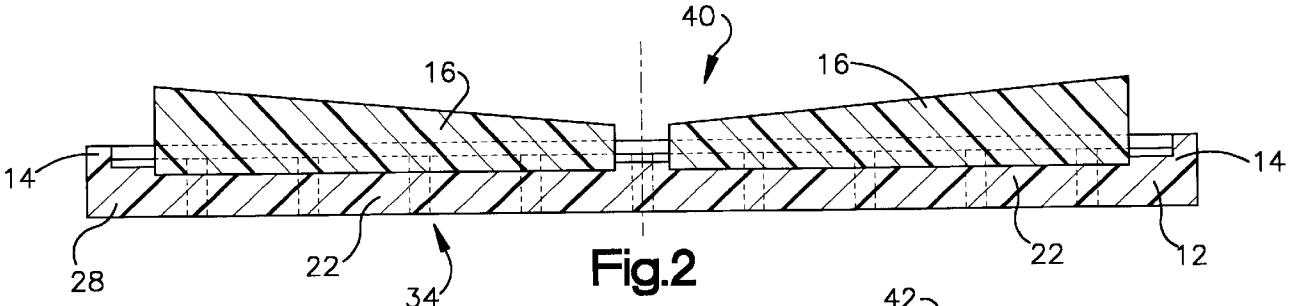
FIG. 2 is a cross-sectional view taken along the plane designated by lines 2—2 in FIG. 1.
Figure 5:
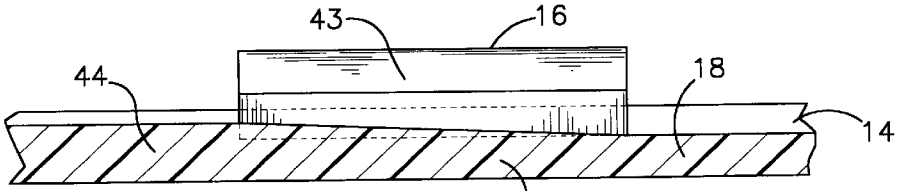
FIG. 5 is a cross-sectional view taken along the plane designated by lines 5—5 in FIG. 1.
Figure 6:
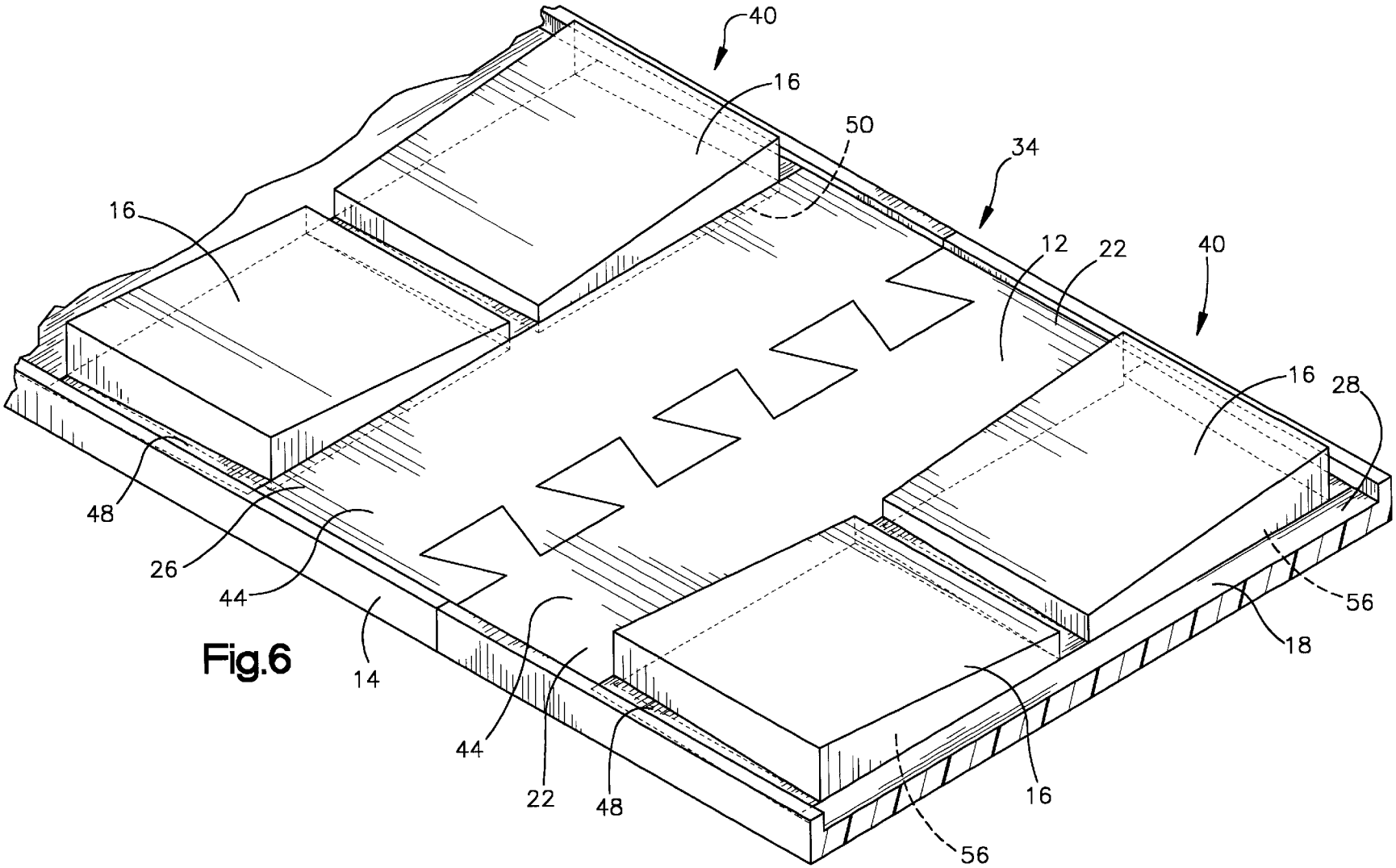
FIG. 6 is an enlarged perspective view of a central portion of the device of the present invention.

The coil support members 16 may either be formed integrally with or separately from the base 12. FIGS. 2, 3 and 5 show the coil support members 16 formed separately from the base 12. Recesses 50 may be formed in the base 12 for receiving the coil supports 16 in the tapered portion 48 (FIG. 6). The coil supports 16 may be connected to the base 12 by any manner known to those skilled in the art. The coil supports 16 may be solid or hollow.

The coil support 10 is preferably comprised of one or more materials including thermoplastic or thermoset materials, engineering resins and polyolefin materials. These materials may be filled with minerals, synthetic fibers and the like. The most preferable material is high density polyethylene, because it has suitable performance, impact strength and stiffness and is economical.

The material of the coil support 10 may include additives such as flame retardants and additives for ultraviolet radiation protection. The coil support 10 may be any color but is preferably black because this color resists degradation by ultraviolet radiation.

The material of the coil support 10 preferably has the following properties: a tensile strength ranging from 1000 to 6000 pounds per square inch ("psi"), a brittleness temperature of −180° F., a heat distortion temperature at 66 psi in the range of 100° to 300° F., a Shore D hardness ranging from 40 to 80, and a flexural modulus ranging from 48,000 to 300,000 psi. The coil support 10 may be formed by processes such as die cutting, injection molding, extrusion or machining.

The method of supporting the coil 11 and collecting the oily fluid from the coil includes positioning the coil such that the coil support members 16 are spaced apart from each other along the longitudinal axis of the coil. The coil is then received in the V-shaped spaces and rested on the coil support members 16. Oily fluid that drips from the coil is received by the tapered portion 48. The oily fluid is directed along the tapered portion 52 toward the outer end portion 48 in the longitudinal direction and collects at the collection area C at the outer end portion 18. The fluid may be removed when accumulation becomes excessive, for example, using a wet vacuum suction apparatus.

Although the invention has been described in its preferred form with a certain degree of particularity, it will be understood that the present disclosure of the preferred embodiments has been made only by way of example and that various changes may be resorted to without departing from the true spirit and scope of the invention as hereafter claimed.

What is claimed is:

1. A coil support for holding a coil of material and containing liquid dripping from the coil, comprising: a floor having a generally rectangular shape: an upstanding peripheral wall extending around at least a portion of said floor: said floor and said wall defining at least one liquid collection portion located adjacent said wall, each said at least one liquid collection portion being constructed and arranged for containing liquid and preventing liquid from flowing from said coil support: said floor having at least one tapered portion downwardly sloped from a central portion of said floor to said at least one liquid collection portion: and coil support members for supporting the coil above said floor, said coil support members being contiguous with said floor, whereby said at least one tapered portion is capable of directing liquid dripping from the coil to flow into said at least one liquid collection portion, said floor being elongated along a length and having opposing ends extending along a width, wherein said at least one liquid collection portion is disposed adjacent one of said ends for the entire width of said floor and said at least one tapered portion leads to said at least one liquid collection portion, said one tapered portion extending across the entire width of said floor.

2. The coil support of claim 1 wherein each of said coil support members has a generally ramp-like shape.

3. The coil support of claim 1 wherein said floor includes two sections and a dovetail joint at said central portion for connecting said sections together.

4. The coil support of claim 1 wherein said coil support members are constructed and arranged to support a coil of steel strip.

5. The coil support of claim 1 wherein said coil support is comprised of elastomeric material.

6. The coil support of claim 1 wherein said base has a lower surface for resting on a support surface, said lower surface being in substantially one plane throughout its entire dimensions.

7. The coil support of claim 1 wherein said coil support members are integrally formed with said floor.

8. The coil support of claim 1 said floor being elongated along a length and having opposing ends extending along a width, said central portion of said floor having substantially no slope in a direction of the length of said floor, said at least one liquid collection portion being disposed adjacent one of said opposing ends.

9. The coil support of claim 1 wherein said coil support is formed as one piece.

10. A method of supporting a coil of material and containing liquid dripping from the coil by placing the coil on a coil support, comprising the steps of:

supporting the coil above a floor of the coil support on coil support members, said coil support members being contiguous with said floor, wherein an upstanding peripheral wall extends around at least a portion of said floor and at least one liquid collection portion is formed by said floor and said wall, each said at least one liquid collection portion being located adjacent said wall;

receiving liquid dripping from the coil onto at least one tapered portion of said floor, said at least one tapered portion being downwardly sloped from a central portion of said floor to said at least one liquid collection portion;

directing the liquid from said at least one tapered portion to said at least one liquid collection portion; and containing the liquid in said at least one liquid collection portion to prevent any liquid dripping from the coil from flowing from the coil support.

11. The method of claim 10 comprising directing the liquid toward said at least one liquid collection portion that is disposed at an end portion of said floor.

12. The method of claim 10 comprising removing the liquid from said at least one liquid collection portion.

13. The method of claim 12 comprising removing the liquid using a vacuum suction apparatus while the coil is supported by said coil support members.

14. A coil support for holding a coil of material and containing liquid dripping from the coil, said coil support comprising: a floor: an upstanding peripheral wall extending around at least a Portion of said floor; at least one liquid collection portion formed by said floor and said wall and located adjacent said wall, each said at least one liquid collection portion being constructed and arranged for containing liquid and preventing liquid from flowing from said coil support: the floor having at least one tapered portion downwardly sloped from a central portion of said floor to said at least one liquid collection portion; and coil support members for supporting the coil above said floor, said coil support members being contiguous with said floor and having a generally ramp-like shape, whereby said at least one tapered portion is capable of directing liquid dripping from the coil to flow into said at least one liquid collection portion, said floor being elongated along a length and having opposing ends extending along a width, wherein said at least one liquid collection portion is disposed adjacent one of said ends for the entire width of said floor and said at least one tapered portion leads to said at least one liquid collection portion, said at least one tapered portion extending across the entire width of said floor.

15. The coil support of claim 14 wherein said floor has a lower surface for resting on a support surface, said lower surface being in substantially one plane throughout its entire dimensions.

16. The coil support of claim 14 wherein said floor has a generally rectangular shape.

17. The coil support of claim 14 wherein said floor includes two sections and a dovetail joint at said central portion for connecting said sections together.

18. The coil support of claim 14 wherein said coil support members are constructed and arranged to support a coil of steel strip.

19. The coil support of claim 14 wherein said coil support is comprised of elastomeric material.

20. The coil support of claim 14 wherein said coil support members are integrally formed with said floor.

21. A coil support for holding a coil of material and containing liquid dripping from the coil, said coil support comprising: a floor: an upstanding peripheral wall extending around at least a portion of said floor: at least one liquid collection portion formed by said floor and said wall and located adjacent said wall, each said at least one liquid collection portion being constructed and arranged for containing liquid and preventing liquid from flowing from said coil support: the floor having at least one tapered portion downwardly sloped from a central portion of said floor to said at least one liquid collection portion: and coil support members for supporting the coil above said floor, said coil support members being contiguous with said floor and having a generally ramp-like shape, whereby said at least one tapered portion is capable of directing liquid dripping from the coil to flow into said at least one liquid collection portion, said floor being elongated along a length and having opposing ends extending along a width, said central portion of said floor having substantially no slope in a direction of the length of said floor, said at least one liquid collection portion being disposed adjacent one of said opposing ends.

* * * * *